United States Patent [19]

Kouklik et al.

[11] 3,985,002

[45] Oct. 12, 1976

[54] METHOD AND APPARATUS FOR MONITORING THE OPERATIVE POSITION DATA OF GROUP CONTROLLED KNITTING MACHINES

[75] Inventors: Ivo Kouklik, Trebic; Josef Navratil, Namest nad Oslavou, both of Czechoslovakia

[73] Assignee: Elitex, Zavody textilniho strojirenstvi generalni reditelstvi, Liberec, Czechoslovakia

[22] Filed: Mar. 26, 1975

[21] Appl. No.: 562,018

[30] Foreign Application Priority Data

Mar. 28, 1974 Czechoslovakia ..... 2222-74

[52] U.S. Cl. ..... 66/154 A; 235/151.1

[51] Int. Cl.[2] ..... D04B 15/66; D04B 15/78

[58] Field of Search ..... 66/50 R, 154 A, 75 A, 66/25 R; 235/151.1; 340/173 SP, 174 SP

[56] References Cited

UNITED STATES PATENTS

| | | | |
|---|---|---|---|
| 3,753,242 | 8/1973 | Townsend | 340/174 SP X |
| 3,807,196 | 4/1974 | Gottsching | 66/50 R |
| 3,817,059 | 6/1974 | Krause | 66/154 A |
| 3,831,402 | 8/1974 | Schuman | 66/50 R |
| 3,844,139 | 10/1974 | De Cerjat et al. | 66/50 R |
| 3,879,963 | 4/1975 | Grozinger | 66/50 R |
| 3,890,806 | 6/1975 | Grozinger | 66/50 R |

FOREIGN PATENTS OR APPLICATIONS

| | | | |
|---|---|---|---|
| 2,091,145 | 1/1972 | France | 66/154 A |

*Primary Examiner*—Mervin Stein
*Assistant Examiner*—A. Falik

[57] ABSTRACT

The method for monitoring the operative position data of each of a plurality of independent separately operable knitting machines and transferring such information to the address input of a common memory control system for controlling the patterning of each machine, is obtained by generating a pick-up pulse at each machine indicative of the passage of its needles and of the completion of each course past a given point. A continuous cycle of timing pulses each of which corresponds to a selected knitting machine for which data is to be monitored is provided. In response to each of the individual timing pulses the respective generated pick-up pulses are fed to a logic control sweep circuit, the output of which is fed to one input of an adding circuit. Simultaneously a second input is fed to the adding circuit comprising the position data information of the immediately preceding needle and course, which had been stored in a random access memory unit corresponding to the particularly monitored machine. The combined output of the adding circuit is simultaneously fed to the address input of the common memory control system for operation of the monitored knitting machine and to the input of the random access memory for storage therein for use in the next monitoring cycle.

12 Claims, 5 Drawing Figures

METHOD AND APPARATUS FOR MONITORING THE OPERATIVE POSITION DATA OF GROUP CONTROLLED KNITTING MACHINES

BACKGROUND OF THE INVENTION

The present invention relates to the method and apparatus for monitoring and transferring the position data of separate, independently operating knitting machines which are commonly controlled by a central memory system, and in particular to a method and apparatus by which the position data is generated by a pick-up at the respective machines being monitored, and fed directly to the central memory without the use of intervening position storage counters.

It has been known to determine the position of the needles and courses in each of the separate knitting machines, of a group of centrally controlled machines, by providing each machine with a position pick-up and wave-shaping circuits, which sense the movement of the knitting machine, particularly the needles thereof, and provide a pulse sequentially responsive to the passage of the needles with respect to the given point. These pulses have been then fed to a counter which registers the sequence of pulses and maintains this count at the same level until a subsequent pulse arrives from the pick-up. The counter thus determines the actual number of needles passing the given point or the actual number of revolutions of the machine, forming the knitted course. During the interval between adjacent pick-up pulses, a pulse is fed to the counter from a decoder, which decoder is driven by a freely independently operable multi-vibrator. This decoder pulse determines the particular machine from the group of N machines which particular machine might record, or obtain, respectively, during the duration of the decoding pulse, information from a central memory bank. Thus, according to the selected frequency of the multivibrator all of the machines may be successively cycled for control by the central memory bank.

A disadvantage of the above mentionied system consists in the fact that each machine must have complicated and expensive counters by which the passage of the needles and courses can be determined. A further disadvantage lies in the fact that the entire device does not insure that a reliable and exact source and recording of the position data of each of the separate machines can be made to the central memory bank.

It is an object of the present invention to provide an improved method and apparatus for the monitoring of a plurality of separate and independent knitting machines and for the transfer of the position data of each of these machines to a central memory control system which overcomes the disadvantages of the known systems.

It is a further object of the present invention to provide a method and apparatus for monitoring and transferring position data of knitting machines, of the type described, which is simpler, has fewer components, and which is less complex than that known in the prior systems.

It is a further object of the present invention to provide a method and apparatus for the monitoring and transferring of position data of individual knitting machines to a central memory control system which is more reliable, efficient and swifter than the heretofore known systems.

The foregoing objects, together with other objects and advantages of the present invention will be seen from the following disclosure of the invention.

SUMMARY OF THE INVENTION

Briefly, the method and apparatus for monitoring the operative position data of each of a plurality of independent and separately operable knitting machines and for transferring such position data to the address input of a common memory control system comprises the generation of a pick-up pulse at each of the machines indicative of the passage of the needles by a given point and the completion of each course. Simultaneously a continuous cycle of timing pulses is generated, each pulse of which corresponds to a selected knitting machine for which data is to be monitored. In response to each of the individual timing pulses, the generated pick-up pulse from each machine is fed to a logic control sweep circuit which is caused to discharge a pulse to the input of an adding circuit. The adding circuit is provided with a second input comprising the position data information of the preceding needle and course corresponding to the particular machine being monitored. This prior position data information is stored in a random access memory, the storage and reading of which is controlled by the corresponding series of timing pulses. The combined output of the adding circuit is simultaneously fed to the address input of the control memory system for pattern operation of the particularly monitored knitting machine and to the input of the random access memory for storage therein so that it may be used in the next subsequent monitoring cycle.

From the foregoing it will be observed that the position data of each of the knitting machines is no longer recorded in a more or less permanent nature in a series of counters but passes through an adding circuit into a random access memory where it is stored only so long as it is necessary to be combined in the adding circuit with the next succeeding position data pick-up pulse. The cyclical, sequential or simultaneous operation of all of the components is effected by a single multivibrator timing control circuit.

Complete details and full aspects of the present invention are set forth in the following disclosure and are illustrated in the accompanying drawings.

DESCRIPTION OF THE INVENTION

Figure 1:
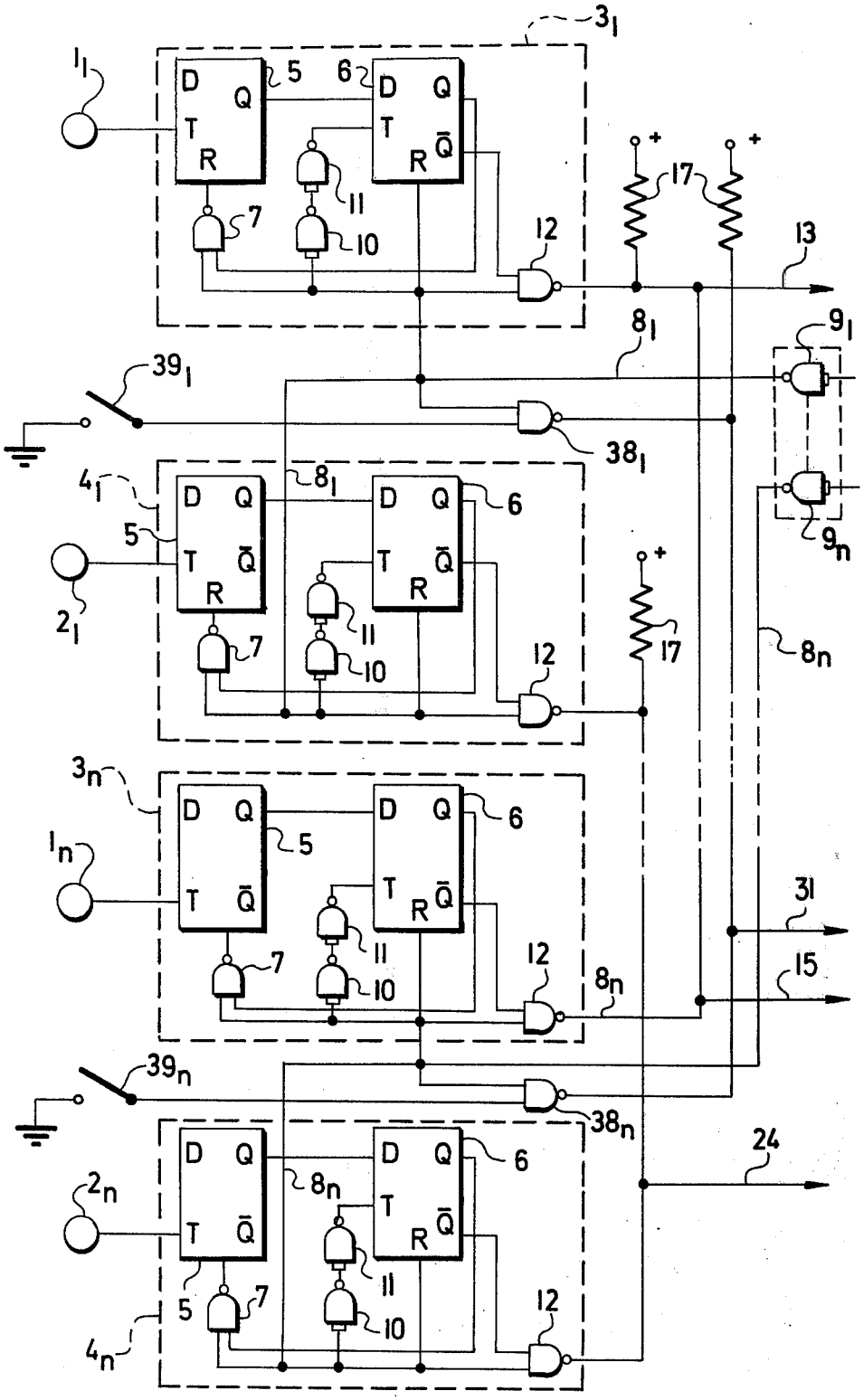
FIG. 1 is a block diagram of the wiring of the input logic sweep circuits for momentarily recording the needle and course pulses of each of the machines in the group being controlled.

Although not illustrated in the drawings, it will be appreciated that each of the knitting machines, to which the present invention is directed is a conventional knitting machine, preferably of the circular shape or double cylinder type having a plurality of needles and sinkers which are selectively operable by one or more selected mechanisms to provide a distinctive predetermined pattern. The patterning is retained in a central memory patterning system of known construction, which in response to the position of a needle within the machine, provides a control command to a given selector.

In each of the machines of the group of N knitting machines illustrated in FIG. 1, there is provided a disc mounted to rotate jointly in conjunction and synchronously with the needle cylinder. About the circumference of the disc there are formed a plurality of openings corresponding in number to the number of needles in the needle cylinder. In addition a single opening is formed in the disc radially inwards toward the center of the disc. A light source is provided on one side of the disc and on the other side of the disc are provided two photoelectric pick-up cells, phototransistors, or similar sensing devices. The first photoelectric cell is arranged to pick up the light pulses passing through the plurality of circumferential holes corresponding to the needles, while the second photosensor is arranged to sense the light pulse passing through the single inner hole thus indicating a full revolution of the disc, corresponding to the passage of the needle cylinder through a single course. This arrangement is more fully described in Czechoslovak Pat. No. 135,196, corresponding to U.S. Ser. No. 649,433.

In FIG. 1, the present invention is illustrated by showing only one needle pick-up $1_1$ for the first machine and the needle pick-up $1_n$ for the last machine in a series of N group of machines. Similarly the course pick-up $2_1$ of the first machine and the course pick-up $2_n$ of the last machine is also illustrated. Each of the pick-ups $1_1$ to $1_n$ are connected respectively to logic control circuits $3_1$ to $3_n$. The course pick-ups $2_1$ through $2_n$ are connected respective to logic control circuits $4_1$ to $4_n$.

Each of the control circuits $3_1$ through $3_n$ and $4_1$ through $4_n$ comprise logic sweep circuits consisting of a pair of bistaple trigger circuits 5 and 6 arranged in series, each of the SN7474 type. The pulses derived from the needle pick-ups 1 and the course pick-ups 2 are fed directly to the clock input T of the first of the trigger circuits 5 while their second inputs D are fixedly biased at a voltage level of a logic value 1. The adjustable or biasing inputs R of each of the triggers 5 is connected to the output of a gate 7 to the first input of each of which are connected lines $8_1$ through $8_n$ leading respectively from a bank of inverters $9_1$ to $9_n$. To the second inputs of each of the gates 7 there is respectively connected the Q output of the trigger 6 associated with it. The Q outputs of the trigger 5 is connected directly to the D input of the trigger 6. The clock input T of the trigger 6 is connected via gates 10 and 11 to the corresponding inverters $9_1$ through $9_n$, through lines $8_1$ through $8_n$ respectively. The adjustable biasing input R of the triggers 6 are similarly connected respectively to lines $8_1$ through $8_n$. The second or Q output of each of the triggers 6 is connected to the first input of a gate 12 interposed in each of the lines $8_1$ through $8_n$. The gate 12 is provided with an open collector output, in the function of "wire-OR." The output from each of the gates 12, belonging to the circuits $3_1$ to $3_n$ are connected in common to a single line 13, which line is itself connected to the input $A_{oj}$ of a counter 14, seen in FIG. 2. The counter 14 is of the SN7483 type and it has its remaining inputs $A_{1j}$ through $A_{7j}$ grounded.

Figure 2:
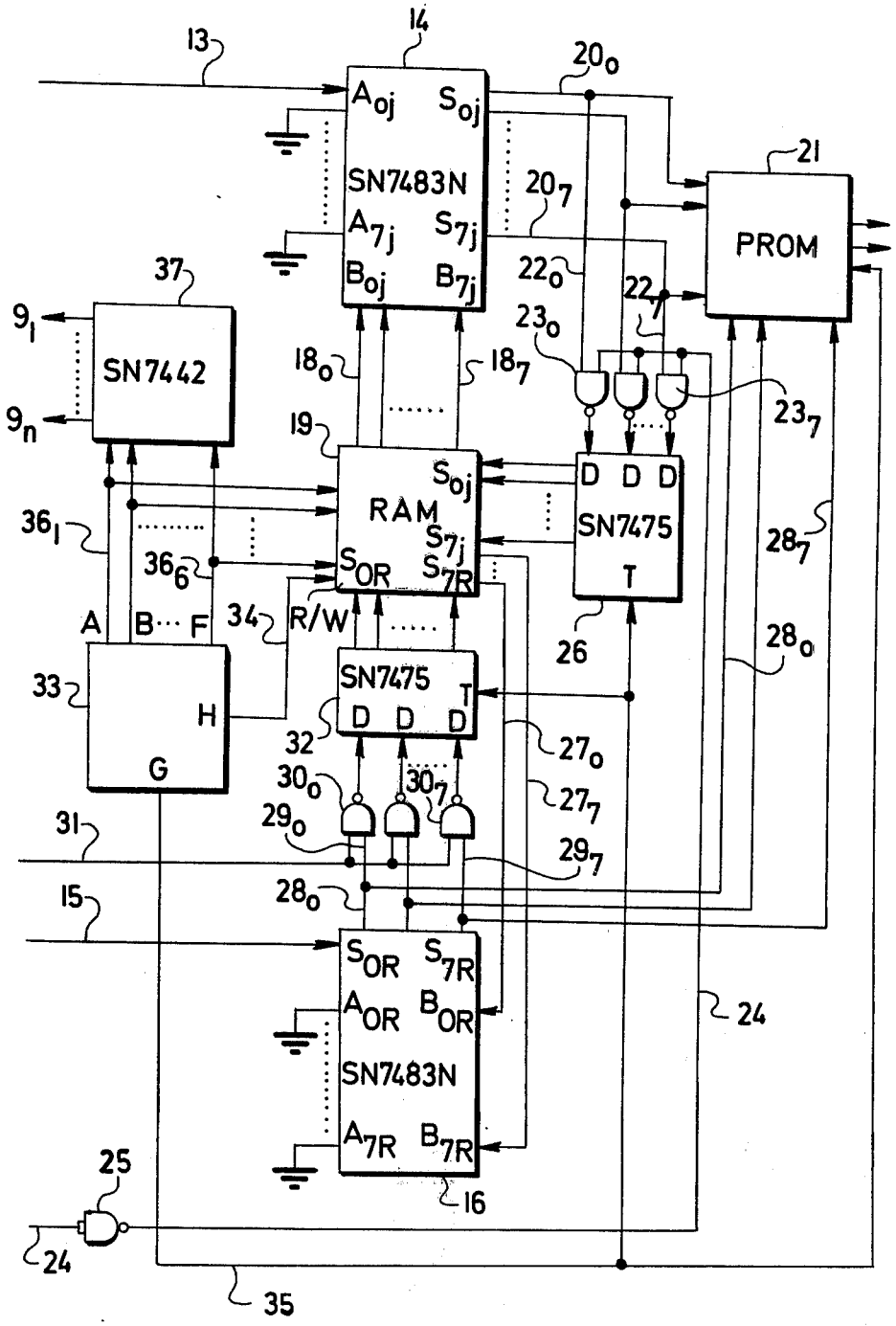
FIG. 2 is a block diagram of the wiring of the control circuits for processing the recorded information for transference to the central memory control system and to a random access memory unit.

The outputs from gates 12 belonging to circuits $4_1$ through $4_7$ are also connected in common to a single line 15 which line is in turn connected to the input $A_{or}$ of a second counter 16, as also seen in FIG. 2. The counter 16 is also of the SN7483 type whose additional inputs $A_{1r}$ to $A_{7r}$ are grounded.

The counter 14 is an adding circuit serving to determine the number of the needle of the machine being monitored, at the time of monitoring. The counter 16 similarly serves as an adding circuit determining the number of the course of the machine being monitored at the time of monitoring.

The collector outputs of each of the gates 12 are connected to operational resistors 17, via lines 13 and 15. The operational resistors 17 are connected to a positive voltage source thus biasing the gates 12 with an open collector.

Turning to FIG. 2, the inputs $B_{oj}$ to $B_{7j}$, of the needle adder counter 14 are connected to the needle data series of outputs $18_o$ through $18_7$ of a random access memory (RAM) 19. The outputs $S_{oj}$ through $S_{7j}$, of the adder counter 14, are connected simultaneously via lines $20_a$ through $27_a$ to the needle address inputs of central memory system 21. The central memory system 21 is of the PROM type (permanent read only memory) having a permanently recorded pattern program corresponding to the lines and courses of the knit work being produced. The central memory 21 has an output which provides a control command pulse for the selection of certain needle selectors, producing the desired pattern.

Lines $22_0$ through $22_7$ (eight in number) are connected respective to lines $20_0$ through $20_7$ and lead to the first input of a series of gates $23_0$ through $23_7$. The other inputs of each of the gates $23_0$ through $23_7$ are connected via a single line 24, in which is incorporated an inverter 25, to the outputs of the gates 12, via the line 13 (FIG. 1). The collector outputs of each of the gates $23_0$ through $23_7$ are respectively connected to the D inputs of a multiple logical sweep circuit 26 capable of information storage. The sweep circuit 26 is of the SN7475 type. The outputs of this sweep circuit 26 are connecteed respectively to the inputs $S_{oj}$ through $S_{7j}$ of the needle data bank of the random access memory 19.

The secondary inputs $B_{or}$ through $B_{7r}$ of the course adder counter 16 are connected via lines $27_0$ through $27_7$ to the series of outputs of the course data bank of the random access memory 19. The output $S_{or}$ to $S_{7r}$ of the course adder counter 16 are connected via lines $28_0$ through $28_7$ to the course address inputs of the central memory unit 21. Lines $29_0$ through $29_7$ are connected to the lines $28_0$ through $28_7$ and lead respectively to one of the inputs of gates $30_0$ through $30_7$. The other inputs of these gates $30_0$ to $30_7$ are connected in common by a line 31 extending from the outputs of gates $38_1$ — $38_m$. The line 15 is connected to the output of gates 12 corresponding to the sweep circuits $4_1$ through $4_n$. The output collectors of each of the gates $30_0$ to $30_7$ are respectively connected to the D inputs of a logical sweep circuit 32 adapted for information storage. The sweep circuit 32, similar to that of the sweep circuit 26 is of the SN7475 type. The outputs of the latter sweep circuit are connected to the inputs $S_{or}$ through $S_{7r}$ of the course data bank of the random access memory 19.

The synchronous function of the foregoing components is obtained through a combination of a freely running pulse generator 33 and a decoder 37. The pulse generator 33 generates a word of n bits, $2^n \ldots N$, on its outputs A through F. The generator 33 includes an output H on which is provided a continuous clock or timing pulse, connected to the R/W (read/write) input of the random access memory 19, via the line 34. The generator 33 also has an outputs G on which continuous clock pulse is provided which is connected via line 35 simultaneously to the clock input T of both the sweep circuits 26 and 32 as well as to the timing input of the central memory system 21. The outputs A to F of the generator 33 are connected respectively via lines $\mathbf{36_1}$ through $\mathbf{36_6}$ to the address inputs of both the decoder 37 and the random access memory 19. The decoder 37 is of the SN7442 type, which performs the operation $1 \times 0$ from $2^n$ bits. The outputs of the decoder 37, connected to the inputs of inverters $\mathbf{9_1}$ $\mathbf{9_m}$ comprise a number which corresponds to each of the machines in the group N. This number is incorporated within the inverters $\mathbf{9_1}$ through $\mathbf{9_n}$ (FIG. 1).

As seen in FIG. 1 the collecting line 31 is joined in common to the open collector outputs of gates $\mathbf{38_1}$ through $\mathbf{38_n}$, which are connected in the function "wire-OR" which belong to each of the sweep circuits $\mathbf{3_1}$ through $\mathbf{3_n}$. One of the inputs of each of the gates $\mathbf{38_1}$ through $\mathbf{38_n}$ is connected respectively to a switch $\mathbf{39_1}$ through $\mathbf{39_n}$. These latter switches are controlled from the control chain or control drum, associated with the knitting machines, for initiating the operation thereof. The control of the drum or chain is accomplished at the beginning of the knitting procedure, by automatic means, or upon failure of the machine by manually operating the control chain or drum. The second input of the gates $\mathbf{38_1}$ through $\mathbf{38_n}$ are respectively connected to lines $\mathbf{8_1}$ through $\mathbf{8_n}$ in the associated sweep circuit $\mathbf{3_1}$ through $\mathbf{3_n}$.

Figure 3:
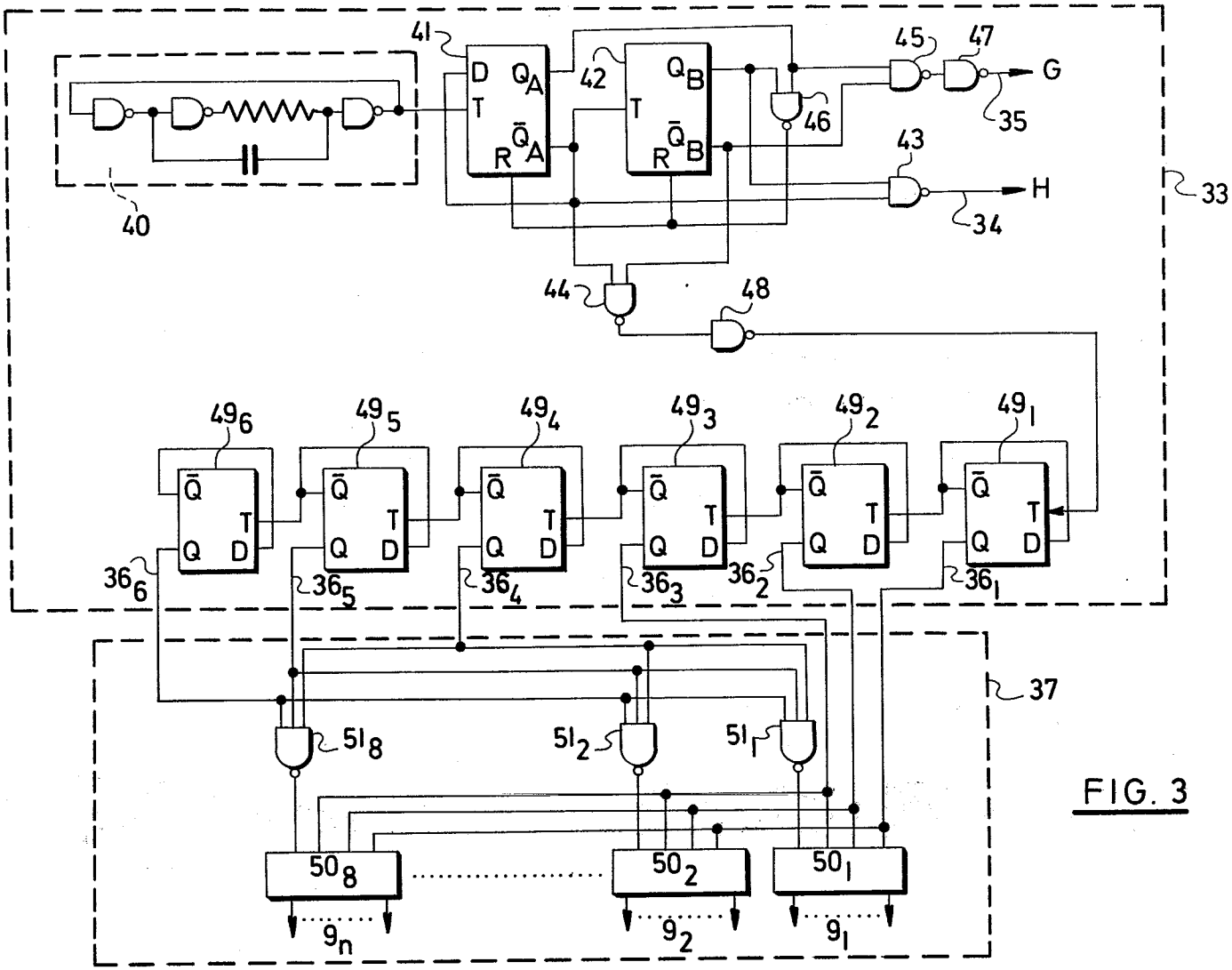
FIG. 3 is a diagram of the multi-vibrator and decoder units forming the timing pulse control portiion of the common control mechanism for N machines.

The construction of the pulse generator 33 and the decoder 37 are seen in more detail in FIG. 3. The pulse generator 33 comprises a multi-vibrator 40 of conventional form adapted to provide a continuous stream of pulses. The output of the multi-vibrator 40 is connected to the clock input T of a trigger circuit or logic sweep circuit 41. The second outut $\overline{Q}$ is connected to the clock input T of a second logic sweep circuit or trigger circuit 42. The D input of the second trigger circuit 42 is connected to a voltage level having a value of logic 1. Both of the circuits 41 and 42 are of the SN7474 type. The output $\overline{Q}_a$ is connected simultaneously to one input of a gate 43 and to one input of a gate 44. The $Q_a$ output of the trigger circuit 41 is connected to one of the inputs of a gate 45 and one of the inputs of a gate 46. The $Q_b$ output of the trigger circuit 42 is connected to the second outputs of each of the gates 43 and 45 while the $\overline{Q}_b$ of the trigger circuit 42 is connected to the second of the inputs of gates 44 and 45 respectively. The output collector of gate 46 is connected to each of the adjustable biasing inputs R of the trigger circuits 41 and 42.

The output of gate 45 is connected to an inverter 47 which is in turn connected to the line 35 while the collector output of gate 43 is connected to the line 34, thus providing the G and H outputs respectively of the generator 33. The output from the gate 44 is fed via an inverter 48 to the clock input T of the first of a series of trigger circuits $\mathbf{49_1}$ through $\mathbf{49_6}$. The $\overline{Q}$ output of the first of these trigger circuits $\mathbf{49_1}$ is connected to the second or D input of the same member $\mathbf{49_1}$ as well as to the clock input T of the second trigger circuit $\mathbf{49_2}$. The Q output of the circuit $\mathbf{49_1}$ is connected by a line $\mathbf{36_1}$ and actually forms the output A of the pulse generator 33. The connection of sweep circuits $\mathbf{49_2}$ through $\mathbf{49_6}$ is identical to the connection of circuits $\mathbf{49_1}$ and $\mathbf{49_2}$, while the Q outputs correspond in order B through F to the outputs of the pulse generator 33 and have lines $\mathbf{36_2}$ to $\mathbf{36_6}$ connected thereto.

The lines $\mathbf{36_1}$ through $\mathbf{36_6}$ are connected respectively to the inputs of the decoder 37. The lines $\mathbf{36_1}$ through $\mathbf{36_3}$ are in fact connected to the separate inputs of circuits $\mathbf{50_1}$ through $\mathbf{50_8}$ which are each of the SN7442 type. Lines $\mathbf{36_4}$ through $\mathbf{36_6}$ are connected via gates $\mathbf{51_1}$ to $\mathbf{51_8}$ to the other input of each of the circuits $\mathbf{50_1}$ through $\mathbf{50_8}$. The number of inputs of the circuits $\mathbf{50_1}$ through $\mathbf{50_n}$ corresponds for the given exemplary case to the number $N = 64$ machines since circuits $\mathbf{50_1}$—$\mathbf{50_1}$ provide $8 \times 8$ outputs. The inverters $\mathbf{9_1}$ to $\mathbf{9_n}$ are connected to the outputs of each of the circuits $\mathbf{50_1}$ to $\mathbf{50_n}$.

Figure 4:
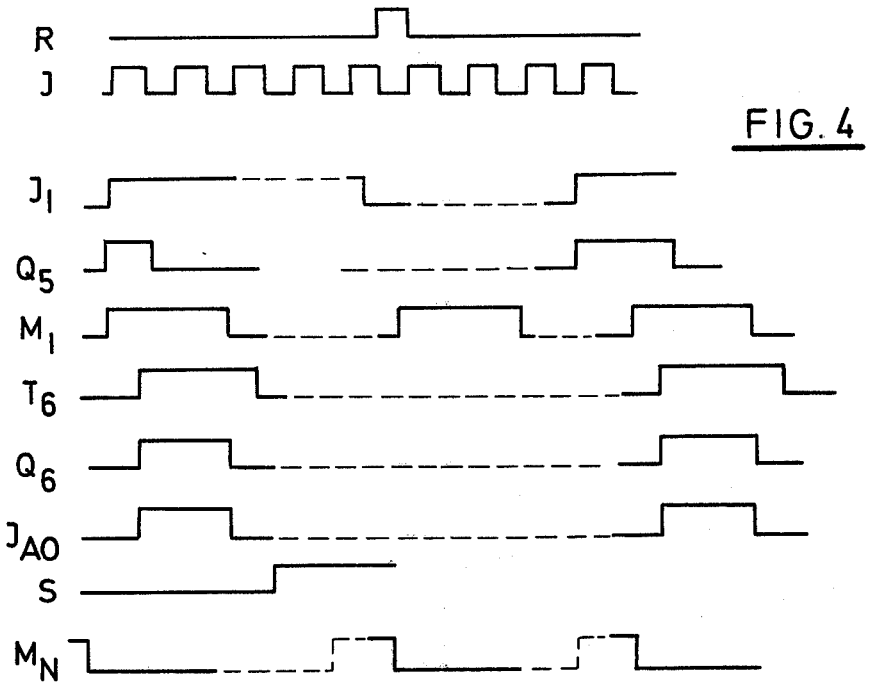
FIG. 4 is the wave form diagram and time course of the pulses in the sweep circuits for one machine.

The method and apparatus depicted above operates as follows:

All of the knitting machines in the group, to be commonly controlled, are set into operation in the normal way. Each of their pick-ups $\mathbf{1_1}$ through $\mathbf{1_n}$ and $\mathbf{2_1}$ through $\mathbf{2_n}$ generate needle and course pulses respectively. To further explain the present invention the following portion of the specification is directed only to the pulse signals received from the pick-ups of the first machine of the group N, namely pick-ups $\mathbf{1_1}$ and $\mathbf{2_1}$. These latter pick-ups produce course pulses R at needle pulses J, both as seen in FIG. 4. Since the output D of the trigger circuit 5 is not variably connected, a constant logic having a value 1 is impressed thereon. The leading edge of a pulse $J_1$ generates a pulse $Q_5$ at the output Q of the trigger circuit 5. This pulse $Q_5$ has a voltage logic value 1, and is transferred with its leading edge to the input terminal D of the trigger circuit 6. In this manner, the trigger circuit 6 is prepared for transmitting the information concerning the rotation of the knitting machine, by an interval equal to 1 cylinder, to the remainder of the circuits indicated in the drawing. The information is transferred from the trigger circuit 6 at the time, when the machine selected for monitoring, by the output of the decoder 37 is provided with a pulse $M_1$. This pulse $M_1$, is emitted into the line $\mathbf{8_1}$ after passing through the inverter $\mathbf{9_1}$. The pulse $M_1$ is delayed by the gates 10 and 11 and forms a pulse $T_6$ at the clock input terminal T of the trigger circuit 6. As a result the condition of the input terminal D of the trigger circuit 6 is transmitted to both of the outputs Q and $\overline{Q}$. This generates at the output Q of the triggeer circuit 6 a pulse $Q_6$ which is recorded on the second input of the gate 7, on the first input of which there had already been recorded the pulse $M_1$, having the logic value 1. Thus at the output of the gate 7 a pulse having the logic value 0 is obtained, which causes zeroing of the trigger circuit 5. The trigger circuit 5 is thus prepared to receive a new or subsequent needle pulse.

Simultaneously with the change on the output Q, of the trigger circuit 6, an inverted pulse of the logic value 0 appears at the output $\overline{Q}$ of the trigger circuit 6. This latter pulse is transmitted to one of the inputs of the gate 12 of the sweep circuit $\mathbf{3_1}$. Meanwhile at the second input of this same gate 12 there had already been recorded the pulse $M_1$, having the logic value 1. Consequently there appears at the output of the gate 12, a pulse $J_{ao}$ having the logic value 1. This pulse $J_{ao}$ is recorded via line 13 at the input $A_{oj}$ of the adder counter 14. When the pulse $M_1$ changes to the logic value 0, at the input R of the trigger circuit 6, this trigger circuit 6 is zeroed.

It will be obvious that in a manner analogous to the procedure described above with respect to the sweep circuit $3_1$, course pulses R from pick-up $2_1$ can be processed in the control sweep circuit $4_1$. The resultant output of this control circuit is recorded at the input $A_{or}$ of the adder counter 16. The same pulse $M_1$ corresponding to the given machine to be monitored, is also used and is introduced via the inverters $9_1$ through $9_n$, into the line $8_1$.

The introduction of the pulse into either the adder counter 14 and the course adder counter 16 via the lines 13 and 15, with the random access memory to define the exact position data of the needle and the course respectively, and the transference of this information to the central memory unit 21 is effected by a timing pulse signal produced by the generator 33 in cooperation with the decoder 37. These two components actually form the control section for each of the machines in the group and produce the separate pulses $M_1$ through $M_n$ which control the monitoring of each of the machines and the transfer of their position pulse signals to the central memory. The pulses $M_1$ through $M_n$ arise as a consequence of the pulses $M_a$ through $M_f$ (FIG. 5) as generated by the generator 33. Thus data about the position of each of the independent machines can be successively supplied to the adder counters 14 and 16 and thus to the central memory 21. For the correct operation of the entire device there is only one necessary condition, that is, the length of the needle pulse of the fastest machine in the group must have a longer interval than the entire time during which all of the machines of the group N are connected to the central memory 21. That is, the cycle for monitoring all of the machines in the group N must be faster than the length of time of the needle pulse of the fastest of the individual machines. This can of course be obtained by conventinal methods by limiting the length of the pulse M with respect to the length of the pick-up pulse derived from the pick-ups 1 and 2.

Turning now to FIG. 2, the input pulses from the pick-ups 1 and 2 are supplied to the adder counter 14, in the rhythm of the frequency of the generator 33 at the outputs A through F. Similarly, the information is supplied to the input of the adder counter 16 in response to the same frequency. Furthermore, generator 33 as seen generates the clock pulses necessary for the operation of the memmory 19, the central memory 21 as well as the trigger circuits 20, 26 and 32.

Figure 5:
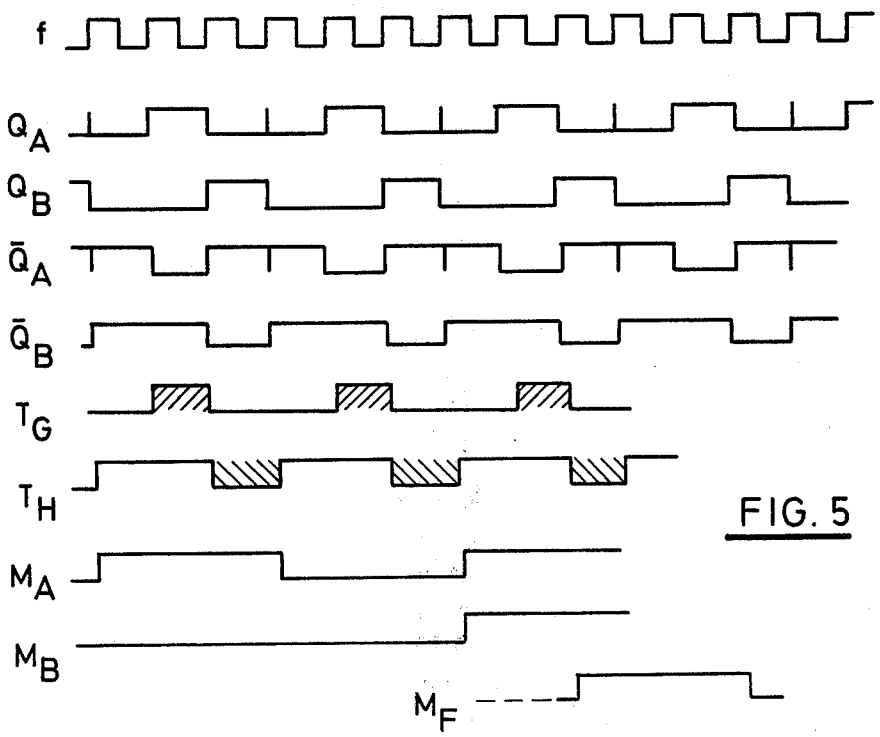
FIG. 5 is the wave form and pulse course for the pulse generator timing circuits.

Referring more particularly to FIG. 5, the multivibrator 40 produces a clock pulse f which is supplied to the clock input T of the trigger circuit 41, FIG. 3, producing at the oututs $Q_a$ and $\overline{Q}_a$ pulses. The output signal $\overline{Q}_a$ from the $\overline{Q}_a$ output is introduced into the first input of the gates 45 and 46 while the signal $Q_a$ from the $Q_a$ output is introduced into the clock input T of the trigger circuit 42 and to the second input D of the trigger circuit 41. This latter pulse is also introduced into one of the inputs of the gate 44. As a consequence of supplying the pulses $\overline{Q}_a$ to the clock input T of the circcuit 42, pulses $\overline{Q}_b$ and $Q_b$ are generated at the ouputs $Q_b$ and $\overline{Q}_b$ respectively. The pulse $Q_b$ is supplied to the inputs of each of the gates 43 and 46 while the pulse $\overline{Q}_b$ is supplied to the input gates 44 and 45. At the output of gate 46, pulses are generated which are supplied to the adjustable biasing inputs R of each of the trigger circuits 41 and 42. These pulses correspond in their time length to the length of three pulses of the pulse wave form f and act to zero the trigger circuits 41 and 42. As a result of the extended length of the zeroing pulse, spurious signals arise in the trigger circuits 41 and 42 during the course of pulses $Q_a$ and $\overline{Q}_a$. These spurious signals however, do not influence the actual operation of the system and the combined circuit 41 and 42 operate substantially as a counter having a module of 3.

The combination of pulses $Q_a$ and $\overline{Q}_b$ on the gate 45 produces, after its inversion within gate 47, a clock pulse $T_g$ which is supplied via line 35 (FIG. 2) directly into the central memory unit 21. The pulse $T_g$ is also directed via line 35 into each of the circuits 26 and 32. When the voltage has a logic value equal to 1, an address is read, or selected from the central memory 21 and also causes the transmission of information from the outputs of each of the circuits 26 and 32 to the respective inputs S of the random access memory 19.

The composition of pulses $\overline{Q}_1$ and $Q_b$ on the gate 41 generates a clock pulse $T_h$ which is transmitted via line 34 (FIG. 2) to the R/W input of the random access memory 19. When the logic value of clock pulse $T_h$ is equal to zero the information supplied to the random access memory 19 from either of the circuits 26 and 32 is recorded thereon. On the other hand, when the value of the clock pulse $T_h$ is equal to logic 1, information is selected from the random access memory 19 to the adder counter 14 and 16 respectively.

Both the clock pulses $T_g$ and $T_h$ have their courses respectively offset in mutual relationship to each other such that the synchronous reading and recording steps indicated above are guaranteed in a reliable, faultless and accurate manner through the cooperation of all of the noted circuits.

The operation of the decoder 37 will also be seen from FIG. 3. The combination of the output pulses from the $\overline{Q}_a$ and $\overline{Q}_b$ outputs of the trigger circuits 41 and 42 produce a pulse on gate 44 which is inverted by the gate 48. This pulse is introduceed into the input T of the first of the cascading circuits $49_1$ at the output of which are generated additional pulses. The pulses from the output $\overline{Q}$ of the circuit $49_1$ is introduced into the clock pulse input T of the second circuit $49_2$ while the pulse from the output Q of the circuit $49_1$, actually constituting the output A of the generator 33 is fed via line 36 into the input of the circuit $50_1$ of the decoder 37. The subsequent operation of circuits $49_1$ to $49_6$ act to process the information and to supply such information via lines $36_1$ to $36_3$, which constitute outputs A, B and C of the generator 33. These outputs are directed to the inputs of circuits $50_1$ through $50_8$ and via lines $36_4$ through $36_6$, which are the outputs D, E and F of the generator 33, to the gates $51_1$ through $51_8$, the output pulses of which are supplied to selected ones of the inputs of circuits $50_1$ through $50_8$. As a result, pulses appear at the outputs of the circuits $50_1$ through $50_8$ which after inversion in the inverters $9_1$ through $9_n$, create pulse forms $M_1$ through $M_n$ which are then successively supplied via lines $8_1$ through $8_n$ to the separate circuits $3_1$ through $3_n$ and $4_1$ through $4_n$ of the machines within the group. The pulses $M_1$ through $M_n$ constitute the signature corresponding to each of the machines within the group. The successive processing of the needle and course pulses from the circuits $3_1$ through $3_n$ and $4_1$ through $4_n$ is explained, for illustration, by example of the pulses from the first machine. The pulse $J_{ao}$ having a logic value of the level 1 is recorded on the input $A_{oj}$ of the adder counter 14. Thus the member 1 is recorded on the counter 14, since the other inputs $A_{1j}$ through $A_{7j}$ are grounded and therefore a 0 value is found on them. The number 1, at the input $A_{oj}$ is added to the number on the inputs $B_{oj}$ to $B_{7j}$, derived from the random access memory 19. This latter number is generally an n-bit digit. For example, if at the inputs $B_{oj}$ through $B_{7j}$ the binary number 00111011 is found it is equal to the number 59 (and at inputs $A_j$ to $A_{7j}$ the number 00000001 is found it is equal to the number 1). As a result the resulting number combined in the adder counter 14 is thus 00111100 which is equal to 60 and indicates the input data of the needle, of the particular machine being monitored, at the moment of monitoring. The input number from the random access memory unit constitutes the immediately preceding number of the needle during the prior cycle of monitoring to which is added the additional one of the present cycle of monitoring. Thus the resulting number equal to 60 will appear in binary digit form on the outputs $S_{oj}$ through $S_{7j}$ on the adder counter 14 which is fed to the central memory 21 and the random access memory 19.

The output from the adder counter 14, is recorded via lines $\mathbf{20}_a$ through $\mathbf{20}_7$ on the one hand in the input to the address needle bank of the central memory 21 and on the input to certain ones of the gates $\mathbf{23}_0$ through $\mathbf{23}_7$. If the pulse value on the other inputs of gates $\mathbf{23}_0$ through $\mathbf{23}_7$ has a value equal to 0, then the passage of information from the gates $\mathbf{23}_0$ through $\mathbf{23}_7$ is passed into the sweep circuit 26. These latter inputs to the gates $\mathbf{23}_0$ through $\mathbf{23}_7$ are connected in common via an inverter 25 to the collecting line 15 and thus on creation of each course pulse, the zeroing of the circuit 26, as well as the memory 19 is respectively accomplished. On the introduction to the circuit 26 of a clock pulse $T_g$ having a logic value of the level 1, the number recorded within the sweep circuit 26 is transmitted to the inputs $S_{oj}$ through $S_{7j}$ of the memory 19 and is recorded in the random access memory 19 for subsequent use on the introduction of a pulse $T_h$ having the value level of 0.

In the same manner as indicated above with respect to the needle pulses, the number indicating the position of the knitted course is analogously made. The pulse received from the position pick-up 2 is respectively processed in the adder counter 16 and the circuit 32 and is recorded on inputs $S_{or}$ to $S_{7r}$ of the random access memory unit 19. Simultaneously, via lines $\mathbf{28}_0$ through $\mathbf{28}_7$ the number is fed to the course data inputs of the central memory 21. The zeroing is performed with respect to the course data in such manner that on certain inputs of gates $\mathbf{29}_0$ through $\mathbf{29}_7$ there is supplied, from an appurtenant machine, via line 31 and via gates $\mathbf{38}_1$ through $\mathbf{38}_n$ a 0 pulse S (FIG. 4) which is generated by closing one of the switches $\mathbf{39}_1$ through $\mathbf{39}_n$, at the start of the corresponding machine.

Pulses $M_a$ through $M_f$ are applied to the address inputs of the random access memory unit 19 via lines $\mathbf{36}_1$ through $\mathbf{36}_7$, simultaneously with the leading edge of the clock pulse $T_h$. Since, the inforamtion as to the number of the needle in the preceding monitoring cycle was already recorded at the inputs $S_{oj}$ through $S_{7j}$ and $S_{or}$ to $S_{7r}$ by that portion of the pulse $T_h$ having a logic value equal to 0, this number, or information, which indicates the data of the needle and of the course of the preceding monitoring cycle is transmitted via lines $\mathbf{18}_0$ through $\mathbf{18}_7$ to the inputs $B_{oj}$ through $B_{7j}$ of the adder counter 14 or to the inputs $B_{or}$ through $B_{7r}$ of the adder counter 16 on the introduction of the pulse clock signal $T_h$ having a value equal to 1. As a result these numbers are added together with the arrival of a further needle or course pulse respectively on the input $A_{oj}$ or $S_{or}$ of the adder counter 14 or 16.

Thus, the sequence of monitoring for each of the machines is repeated as the control generator 33 and decoder 37 cycle through the successive monitoring of each of the machines in the group. The reading, or selection of information, from the central memory 21 is performed at all times on the arrival of the leading edge of the clock pulse $T_g$ having a logic value of the level 1. As a result of which, a command signal output from the central memory to the respective needle selector correspnding both to the needle and in particular to the machine being monitored is obtained directly with a pulse received from the pick-up associated with that machine without the intervention more or less of permanent counters.

In the practice according to the present invention, the adder counters 14 and 16 might be replaced with arithmetical logic units, for example of the SN74181 type, appropriately wired to obtain the results discussed above. Generally, instead of an air, a logic circuit adding input information might also be used. It will be seen from the foregoing that the advantage of the present invention lies in the fact that by means of adders and a random access memory the information about the momentary position of a needle in a needle cylinder, with respect to each machine, from the group N, is accurately stored and in cooperation with the PROM memory system, the information may be transmitted to the separate knitting machines via the logic circuit in which the information may be momentary stored. The circuits and components referred to in the foregoing description are known and readily available commercially. The circuits SN7474, 7483, 7475, 7442, 7474, 7418, as well as the multi-vibrator, the random access memory (RAM), and the central memory core (PROM) in addition to the gates, etc. described herein are products of the Texas Instruments Company, Houston, Texas. Similar circuits are also manufactured by the Fairchild Semi-Conductor Company, 464 Ellis Street, Mountainview, California, 94040. In the catalog of the Fairchild Semi-Conductor Company of June, 1972 there is a comparison between the circuits of the Texas Instrument Company and Fairchild which show their equivalency, construction and mode of operation. Reference may be made to this publication and incorporated within this disclosure as if more fully set forth.

Furthermore, reference can be made for general information regarding several electronic control systems for knitting machines, to the publication "Electronics in Knitting," Charles Reichman, Editor, American Society of Knitting Technologist and the National Knitted Outwear Association, 1972. For more specific information concerning other components, such as counters, recording matrix, reading devices, etc. reference to applicant's co-pending applications can be made as follows:

Ser. No. 342,941 now U.S. Pat. No. 3,861,174, Jan. 21, 1975 filed Mar. 20, 1973

Ser. No. 246,623 now abandoned filed Apr. 24, 1974

Ser. No. 246,792 now abandoned filed Apr. 24, 1974

Ser. No. 246,791 now U.S. Pat. No. 3,874,198, Apr. 1, 1975 filed Apr. 24, 1972

Ser. No. 246,699 now abandoned filed Apr. 24, 1972

Ser. No. 486,321 still pending filed July 8, 1974

Ser. No. 486,322 still pending filed July 8, 1974

Ser. No. 519,830 still pending filed Nov. 1, 1974

Various changes, modifications and embodiments have been suggested in the foregoing disclosure. Other changes and embodiments will be obvious to those skilled in the present art. It is intended therefore that the present disclosure be taken as being illustrative only of the present invention and not as limiting of its scope.

What is claimed is:

1. A method for monitoring the operative position data of each of a plurality of independent separably operable knitting machines and for transferring said data to the address of a common memory control system by which control of the patterning operation of each of the machines is carried out, comprising the steps of: generating a pickup pulse at each machine indicative of the passage of the needles in each course and of the passage of the courses in the knitting pattern, generating a continuous cycle of timing pulses each of which corresponds to a selected knitting machine for which data is to be monitored, and in response to each of said timing pulses feeding the generated pick-up pulse from each machine to a logic control sweep circuit, discharging said logic control sweep circuit to one input of an adding circuit, simultaneously feeding to said adding circuit a second input comprising the position data information of the preceding needle and course, stored in a random access memory, corresponding to said monitored machine, and combining the input from said logic control sweep circuit and said position data information to form a combined output, transferring the combined output of said adding circuit simultaneously to the address input of said control memory system and to the input of the random access memory for storage therein to be used in the next subsequent monitoring cycle.

2. The method according to claim 1 wherein the pick-up pulse from each machine is led to the clock input of a first trigger circuit, the second input of which is connected to a logic value having a leve 1, the output of said first trigger circuit is transmitted to the input of a second trigger circuit, the other input of which receives said timing pulse, the output of said second trigger circuit being fed to said adding circuit.

3. The method according to claim 1, wherein said timing pulse controls the recording of pick-up pulses from said adder in said random access memory and the output of said pulses from the random access memory to the inputs of said adding circuits in a sequential manner.

4. The method according to claim 1, wherein the total of said timing pulses extends over an interval less than the fastest pick-up pulse of said plurality of machines.

5. The method according to claim 1, including the step of decoding the timing pulse to provide a signal indicative of each of the said machines in the group being monitored, said pick-up being responsive to said signature signal.

6. Apparatus for monitoring the operative position data of each of a plurality of independently operable circlar knitting machines and for transferring the data to the address input of a common memory control system to control the pattern operation of each machine comprising, means responsive to the operation of said knitting machine to provide a sequence of pulses indicative of the needle position and the course number with respect to a given point about the circumference of said machine, means for generating a continuous cycle of timing pulses each of which corresponds to a selected knitting machine for which data is to be monitored, a first and second sweep circuit for processing said needle and course position pulses and providing an output in response to a given timing pulse, first and second adding circuits connected to said first and second sweep circuits respectively for receiving said output thereof, a random access memory to which position data information is stored, the output of said random access memory being connected to each of said first and second adding circuits and being responsive to said timing signal to provide an output to each of said first and second adding circuits, said first and second adding circuits, responsive to said timing pulse providing an output signal combining the input from said first and second sweep circuit and from said random access memory said first and second adding circuits being simultaneously connected to both the input of said random access memory and to said common memory control system whereby in response to said timing signal said combined output can be fed thereto.

7. The apparatus according to claim 6, wherein said knitting machine comprises a circular knitting machine and said pick-up means comprises a sensor adapted to sense the passage of each needle and produce a sequence of pulses with respect thereto and to sense the passage of the cylinder through a revolution and provide a signal indicative thereof.

8. The apparatus according to claim 6, wherein each of said first and second sweep circuits comprise a first trigger circuit having two inputs one input of which is connected to a voltage source having a logic 1 and the second of which is connected to the output of said associated pick-up means, and a second trigger circuit having an input connected to the output of said first trigger circuit and an input for timing pulses connected to the output of said means for generating said timing pulses, means inserting the output of said second trigger circuit and connecting the same to one input of a gate with an open collector, said open collector being connected to the input of the adding circuit, said adding circuit having a second input connected to the source of timing pulses, the output of said second trigger circuit being connected to a first input of a second gate, the second input of said gate being connected to the source of timing pulses, the output of said second gate being connected to a zeroing input of said first triggering circuit.

9. The apparatus according to claim 8, wherein the gates connecting said second trigger circuit with said corresponding adding circuit have open collector outputs which are connected in the function "wire-OR," said gates being connected to one input of said adder adding circuits, the other inputs of said adding circuits being grounded.

10. The appratus according to claim 6 wherein the other inputs of said adding circuits, are connected to the outputs of the needle or course data banks respectively of the random access memory, the inputs of said needle or course data banks respectively of the random access memmory are connected via logic sweep circuits for storing information to the outputs of said adding circuits and the address inputs of the random access memory are connected to the outputs of said means for producing said timing pulses.

11. The apparatus according to claim 10, including an output of continuous clock pulses from said source of timing pulses, connected to an R/W input of said random access memory and a second output of continuous clock pulses connected to the input of the logic sweep circuits for storing information.

12. The apparatus according to claim 11, including a plurality of gates arranged respectively at the inputs of said logic sweep circuits for storing information, the gates associated with the needle position pulse, having second inputs connected in common with the source of course position pulses, a gate interposed within said common line having an open collector in the function "wire-OR," the gates associated with the course position pulses having a common collector line connected to a switch associated with each of the machines within said group, and a gate having an open collector in the function "wire-OR" interposed therein.

* * * * *